US011401732B2

(12) United States Patent
Zacchio et al.

(10) Patent No.: US 11,401,732 B2
(45) Date of Patent: Aug. 2, 2022

(54) MODULAR LOCK MECHANISM

(71) Applicant: Carrier Corporation, Jupiter, FL (US)

(72) Inventors: Joseph Zacchio, Wethersfield, CT (US); Nicholas Charles Soldner, Mountainview, CA (US); Lawrence Binek, Glastonbury, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 288 days.

(21) Appl. No.: 16/490,345

(22) PCT Filed: Feb. 28, 2018

(86) PCT No.: PCT/US2018/020238

§ 371 (c)(1),
(2) Date: Aug. 30, 2019

(87) PCT Pub. No.: WO2018/160703

PCT Pub. Date: Sep. 7, 2018

(65) Prior Publication Data

US 2020/0071953 A1 Mar. 5, 2020

Related U.S. Application Data

(60) Provisional application No. 62/465,348, filed on Mar. 1, 2017.

(51) Int. Cl.
*E05B 15/00* (2006.01)
*E05B 19/00* (2006.01)
(Continued)

(52) U.S. Cl.
CPC ..... *E05B 15/0073* (2013.01); *E05B 19/0005* (2013.01); *E05B 47/004* (2013.01); *E05B 47/02* (2013.01); *E05C 19/009* (2013.01)

(58) Field of Classification Search
CPC .. Y10T 292/11; Y10T 292/14; Y10T 292/096; Y10T 292/0969; Y10T 292/1021;
(Continued)

(56) References Cited

U.S. PATENT DOCUMENTS 1,635,144 A 7/1927 Stevens
3,566,636 A * 3/1971 Rudolf et al. ..... E05B 47/0045 70/276
(Continued)

FOREIGN PATENT DOCUMENTS

CN 2575250 Y 9/2003
CN 2746076 Y 12/2005
(Continued)

OTHER PUBLICATIONS

International Search Report for International Application No. PCT/US2018/020238, dated June 4, 2018, 6 pages.
(Continued)

*Primary Examiner* — Christine M Mills
*Assistant Examiner* — Steven A Tullia
(74) *Attorney, Agent, or Firm* — Cantor Colburn LLP

(57) ABSTRACT

A locking module for selectively coupling a first component and a second component of a lockable device includes a housing and a magnet arranged within said housing. A locking element is movable relative to said housing between an unlocked position and a locked position. An engagement member is operable to selectively decouple said locking element from said magnet to move said locking element between said unlocked position and said locked position.

18 Claims, 7 Drawing Sheets

(51) Int. Cl.
*E05B 47/00* (2006.01)
*E05B 47/02* (2006.01)
*E05C 19/00* (2006.01)

(58) Field of Classification Search
CPC ..... Y10T 292/696; Y10T 292/699; E05B 15/0073; E05B 15/006; E05B 19/0005; E05B 19/09; E05B 19/009; E05B 19/007; E05B 19/16; E05B 19/163; E05B 19/04; E05B 47/004; E05B 47/02; E05B 47/0038; E05B 47/0001; E05B 47/0003; E05B 47/0004; E05B 47/0012; E05B 47/06; E05B 47/0603; E05B 47/00; E05B 47/0044; E05B 47/00455; E05B 63/121; E05C 17/56; G07C 9/00944
USPC ..... 70/163, 276, 413
See application file for complete search history.

(56) References Cited

U.S. PATENT DOCUMENTS 3,858,280 A 1/1975 Martens
3,911,534 A 10/1975 Martens et al.
4,339,853 A 7/1982 Lipschitz
4,425,771 A * 1/1984 Beach ..... E05B 47/0038 292/251.5
4,453,449 A 6/1984 Hollmann
5,061,112 A 10/1991 Monford, Jr.
5,362,116 A * 11/1994 Doyle ..... E05C 19/163 292/144
5,664,445 A 9/1997 Chang
6,415,476 B1 * 7/2002 McCoy ..... E05B 15/10 16/224
6,474,120 B1 * 11/2002 Wadsworth ..... E05B 63/185 292/251.5
7,044,511 B2 * 5/2006 Kliefoth ..... E05C 19/163 292/251.5
9,297,189 B2 * 3/2016 Ho ..... E05C 19/16
9,523,219 B2 * 12/2016 Macernis ..... E05B 65/0014
2003/0024079 A1 * 2/2003 Morita ..... A45C 13/1069 24/303
2005/0206499 A1 * 9/2005 Fisher ..... E05B 47/0603 340/5.73
2006/0049645 A1 * 3/2006 Drumm ..... E05C 19/163 292/251.5
2006/0174455 A1 8/2006 Saitoh et al.
2007/0029816 A1 * 2/2007 Chen ..... E05B 47/004 292/251.5
2007/0138806 A1 * 6/2007 Ligtenberg ..... H05K 5/0221 292/251.5
2008/0169890 A1 * 7/2008 Irwin ..... E05B 47/026 335/228
2008/0296915 A1 * 12/2008 Clark ..... E05B 63/20 292/251.5
2010/0289276 A1 * 11/2010 Tang ..... E05B 51/005 292/263
2011/0101706 A1 * 5/2011 Wells ..... E05C 19/163 292/179
2011/0148126 A1 * 6/2011 Macernis ..... E05B 65/0007 292/251.5
2011/0209509 A1 * 9/2011 Nickeas ..... E05B 47/0045 70/276
2012/0067090 A1 * 3/2012 Varney ..... E05B 65/46 70/81
2014/0047677 A1 * 2/2014 Trinh ..... G06F 1/1679 24/303
2014/0054904 A1 * 2/2014 Andrews ..... E05C 19/163 292/144
2014/0225383 A1 * 8/2014 Simmonds ..... E05C 1/08 292/238
2014/0319850 A1 10/2014 Berger et al.
2015/0237748 A1 * 8/2015 Andre ..... E05B 17/0033 361/679.55

FOREIGN PATENT DOCUMENTS

CN 105909075 A 8/2016
DE 4426430 A1 2/1996
DE 102011119475 A1 5/2013
DE 102016112214 A1 * 1/2018 ..... H01F 7/0242
DE 102017208987 A1 * 11/2018 ..... E05B 47/026
EP 0590206 A1 9/1992
EP 0545494 A1 11/1992
EP 1820924 A1 * 8/2007 ..... E05C 19/163
EP 1914368 A2 4/2008
EP 2372068 A2 * 10/2011 ..... E05G 1/04
EP 3272975 A1 * 1/2018 ..... E05B 47/004
GB 2182713 A * 5/1987 ..... E05B 47/0038
JP 0978926 A 3/1997
JP 4360515 B2 11/2009
WO WO-2007069047 A2 * 6/2007 ..... E05B 47/0692
WO 2008074642 A1 6/2008
WO WO-2011123478 A1 * 10/2011 ..... E05C 3/02
WO 2015140585 A1 9/2015

OTHER PUBLICATIONS

Written Opinion for International Application No. PCT/US2018/020238, dated Jun. 4, 2018, 9 pages.
International Preliminary Report on Patentability for Application No. PCT/US2018/020238; dated Sep. 3, 2019; 9 Pages.

* cited by examiner

MODULAR LOCK MECHANISM

CROSS REFERENCE TO RELATED APPLICATIONS

This application is a National Stage application of PCT/US2018/020238, filed Feb. 28, 2018, which claims the benefit of U.S. Provisional Application No. 62/465,348, filed Mar. 1, 2017, both of which are incorporated by reference in their entirety herein.

BACKGROUND

This disclosure relates generally to a lockable device and, more particularly, to a locking module for use in a lockable device.

Lockboxes typically provide a secured storage area for a key or other access aid at a location close to a locked property accessible by the key. In this way, an authorized user can unlock the lockbox to gain access to the secured storage area and then use the key container therein to unlock the locked property.

The lockbox is typically attached to a door handle or to another stationary object near the traditional lock. The lockbox typically requires the user to demonstrate that he is authorized to obtain access to the locked property before the secured storage area is unlocked to allow the user to obtain the key. In a mechanical lockbox, the user might be required to enter a correct lock combination to access the secured storage area. In an electronic lockbox, the user might be required to communicate a credential to lockbox (via a physical connection to the lockbox or via a wireless link to the lockbox) to access the secured storage area.

SUMMARY

According to one embodiment, a locking module for selectively coupling a first component and a second component of a lockable device includes a housing and a magnet arranged within said housing. A locking element is movable relative to said housing between an unlocked position and a locked position. An engagement member is operable to selectively decouple said locking element from said magnet to move said locking element between said unlocked position and said locked position.

In addition to one or more of the features described above, or as an alternative, in further embodiments in said unlocked position, said locking element is positioned within said housing.

In addition to one or more of the features described above, or as an alternative, in further embodiments in said locked position, a portion of said locking element extends outwardly beyond a first end of said housing.

In addition to one or more of the features described above, or as an alternative, in further embodiments said locking element includes a magnetic material.

In addition to one or more of the features described above, or as an alternative, in further embodiments said engagement member includes a contoured surface configured to cooperate with said locking element.

In addition to one or more of the features described above, or as an alternative, in further embodiments said contoured surface includes an angled surface.

In addition to one or more of the features described above, or as an alternative, in further embodiments said magnet is a permanent magnet.

In addition to one or more of the features described above, or as an alternative, in further embodiments said magnet is formed from an alloy of neodymium.

In addition to one or more of the features described above, or as an alternative, in further embodiments comprising a mechanism operably coupled to said engagement member.

In addition to one or more of the features described above, or as an alternative, in further embodiments said mechanism is a mechanical mechanism that operates the engagement member in response to a user input.

In addition to one or more of the features described above, or as an alternative, in further embodiments said mechanism is an electromechanical mechanism that operates the engagement member in response to a user input.

In addition to one or more of the features described above, or as an alternative, in further embodiments said mechanism moves said engagement member in a first direction and engagement member is operable to apply a normal force to said locking element.

In addition to one or more of the features described above, or as an alternative, in further embodiments comprising a detent arranged adjacent said housing, said detent being aligned with said housing such that said locking element is receivable within said detent, and a shield positioned adjacent said detent, said shield being capable of reducing or negating an external magnetic field applied to said detent to move said locking element to said unlocked position.

According to another embodiment, a method of operating a locking module of a lockable device includes operating a mechanism in response to a user input, moving an engagement member operably coupled to said mechanism out of contact with a locking element of the locking module, and attracting said locking element with a magnetic field to move said locking element from a first position to a second position.

In addition to one or more of the features described above, or as an alternative, in further embodiments said magnetic field acts on said locking element in both said first position and said second positon.

In addition to one or more of the features described above, or as an alternative, in further embodiments a permanent magnet is arranged within a housing of the locking module to attract said locking element.

According to another embodiment, a method of operating a locking module of a lockable device includes operating a mechanism in response to a user input, moving an engagement member operably coupled to said mechanism into engagement with a portion of a locking element of the locking module, and applying a force to said locking element in a direction opposite a magnetic field attracting said locking element to move said locking element from a first position to a second position.

In addition to one or more of the features described above, or as an alternative, in further embodiments said force applied to said locking element is generally perpendicular to movement of said engagement member.

In addition to one or more of the features described above, or as an alternative, in further embodiments said mechanism is operable in response to a mechanical input.

In addition to one or more of the features described above, or as an alternative, in further embodiments said mechanism is operable in response to an electromechanical input.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1A:
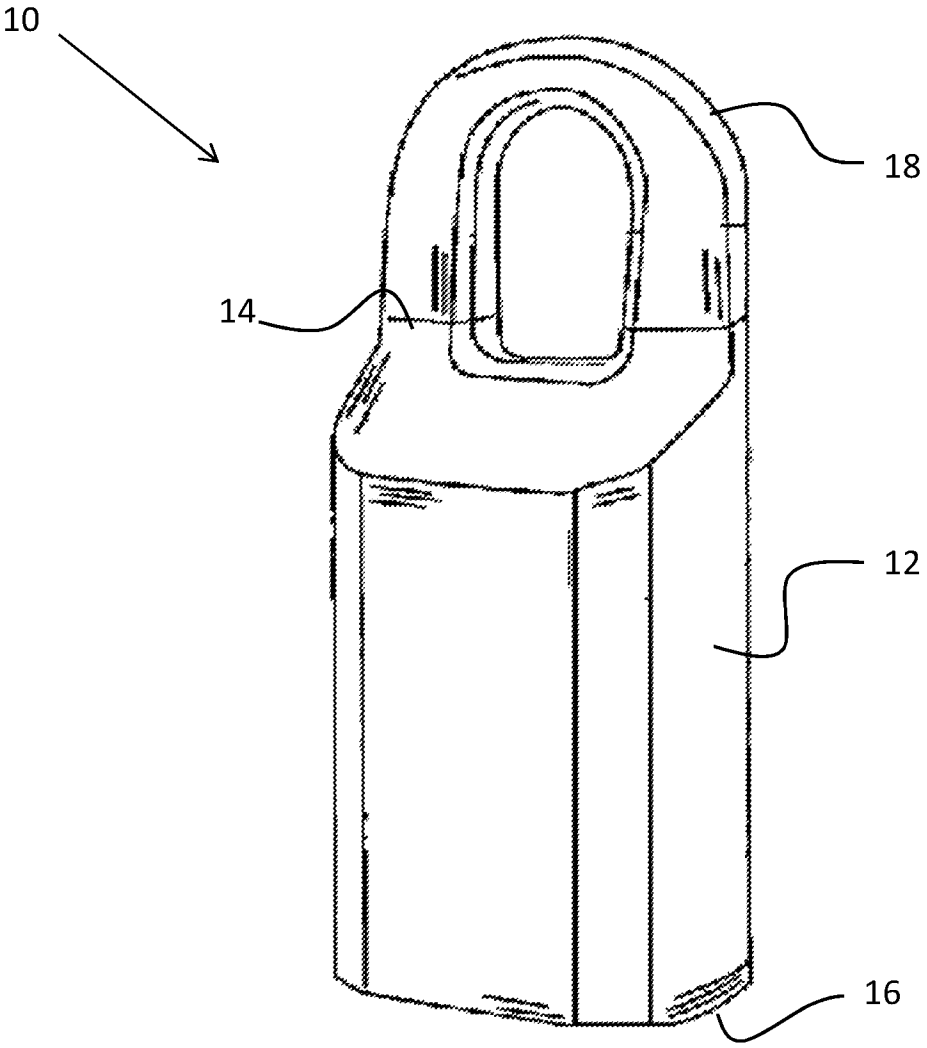
FIG. 1A is a perspective view of an example of a lockable device in a closed configuration.
Figure 1B:
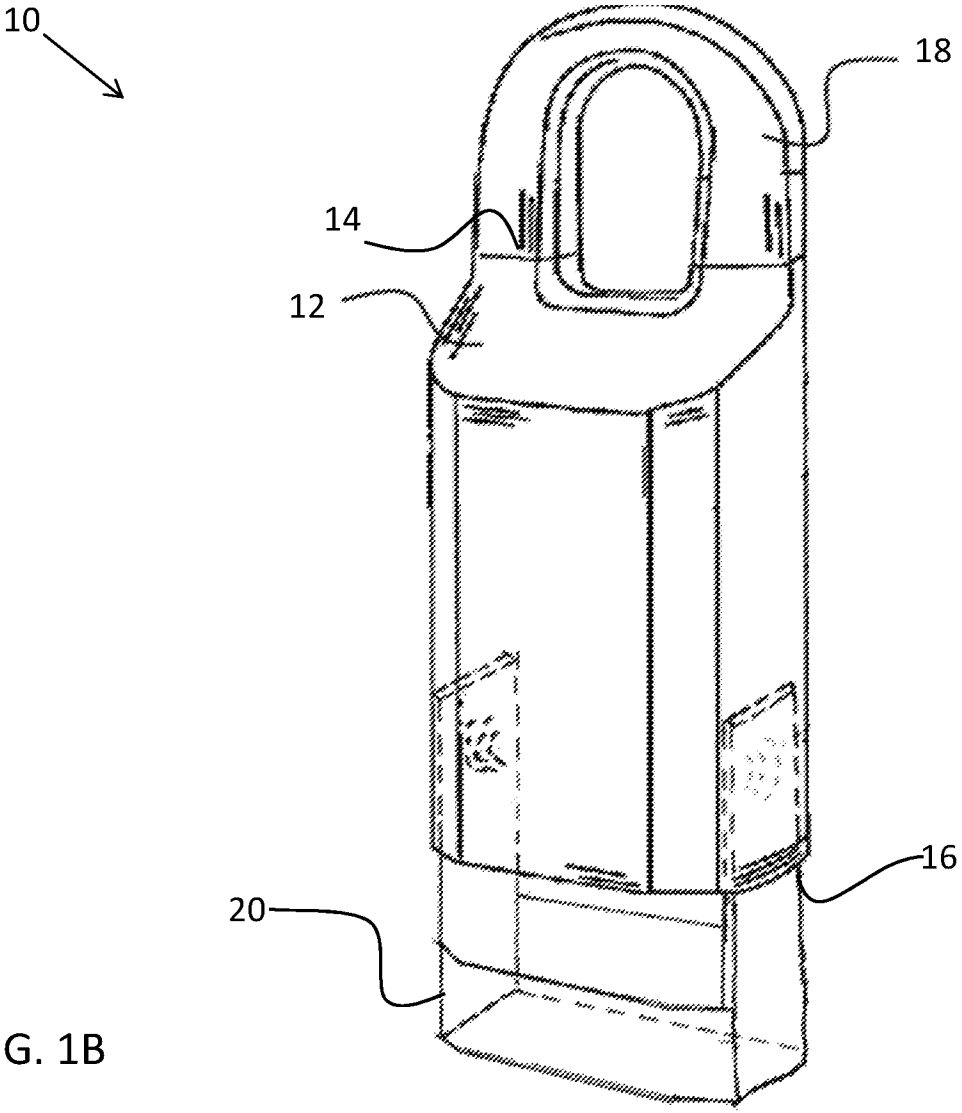
FIG. 1B is a perspective view of an example of a lockable device having a keybox in an extended position.
Figure 1C:
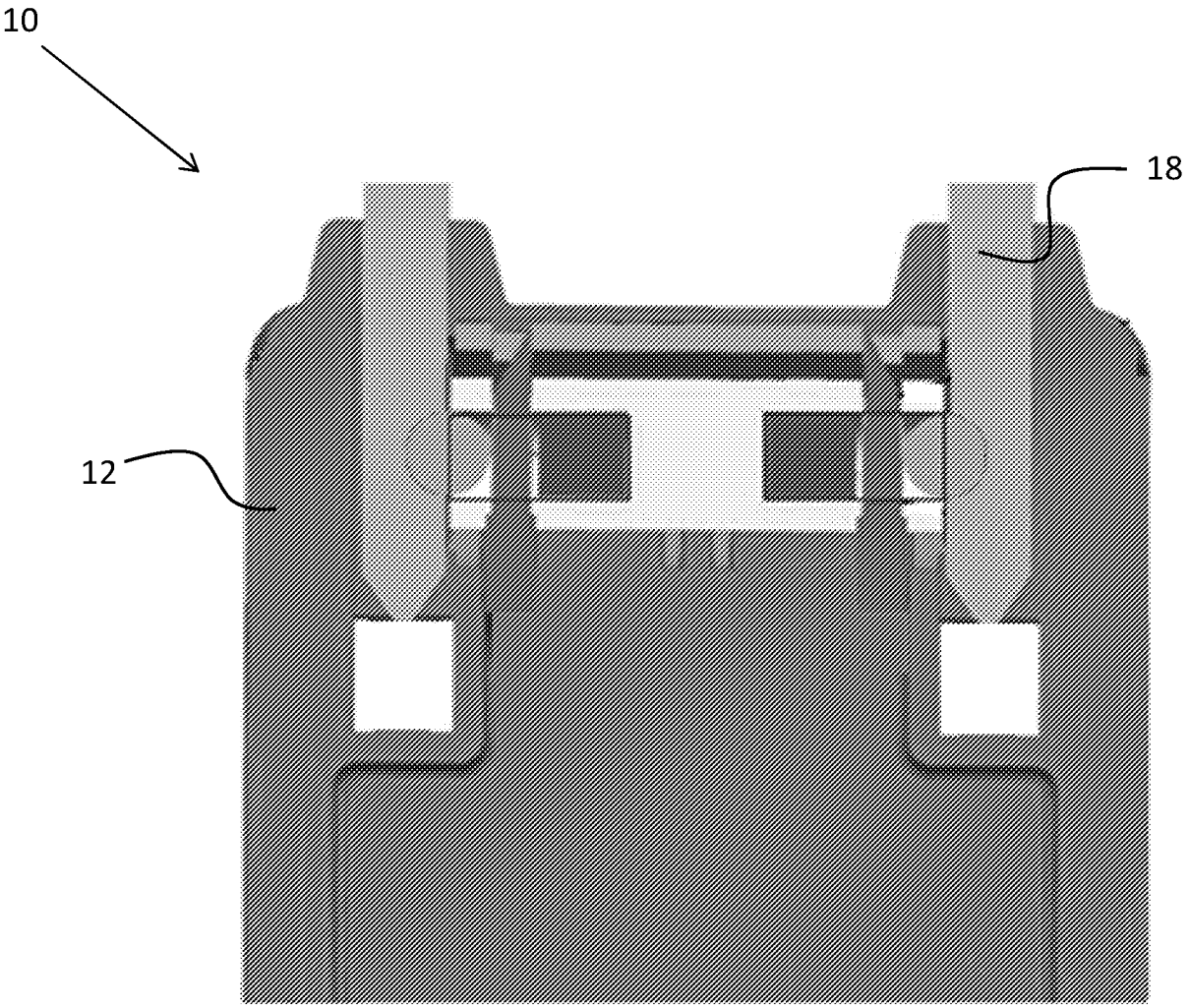
FIG. 1C is a cross-sectional view of a portion of the example of a lockable device in a closed configuration.

Referring now to FIGS. 1A-1C, an example of a lockable device 10, such as a lockbox is illustrated. The lockbox 10 includes a body 12 and one or more components movable relative to the body 12. For example, the lockbox 10 additionally includes a shackle 18 positioned adjacent a first end 14 of the body 12 and a keybox 20 (best shown in FIG. 1B) positioned adjacent a second, opposite end 16 of the body 12. The shackle 18 may be configured to translate and/or rotate relative to the body 12. Alternatively, or in addition, the keybox 20 may be configured to translate relative to the body 12. In an embodiment, at least one of the shackle 18 and the keybox 20 is separable from the body 12.

A locking module 30 is operable to selectively couple a first component and a second component. In an embodiment, when applied to a lockable device, such as lockbox 10 for example, the locking module 30 selectively locks the shackle 18 to the body 12. Accordingly, the locking module 30 restricts movement of the lockbox 10 once arranged in a desired location via the shackle 18. Alternatively or in addition, the locking module 30 may be used to selectively lock the keybox 20 to the body 12. In such instances, operation of the locking module 30 may provide an authorized user with access to the internal cavity of the keybox 20, within which one or more items, such as a key for example, may be stored.

With reference now to FIGS. 2-5, a locking module 30 configured to selectively couple the keybox 20 to the body 12 of a lockbox 20 is illustrated in more detail. The locking module 30 includes a housing 32 coupled to or located within a first component, such as the interior of the body 12 of the lockbox 10. The housing 32 includes a generally hollow interior 34 and is positioned such that a first end 36 thereof is generally aligned with an end 38 of the first component 12. In an embodiment, the housing 32 is formed from a piece of tubing or channel of any suitable material, such as stainless steel for example.

Arranged within the housing 32, adjacent a second end 40 is a magnet 42. In an embodiment, the magnet 42 is a permanent magnet, such as made from an alloy of neodymium for example. However, other types of magnets, for example electromagnets, are also within the scope of the disclosure.

Figure 2:
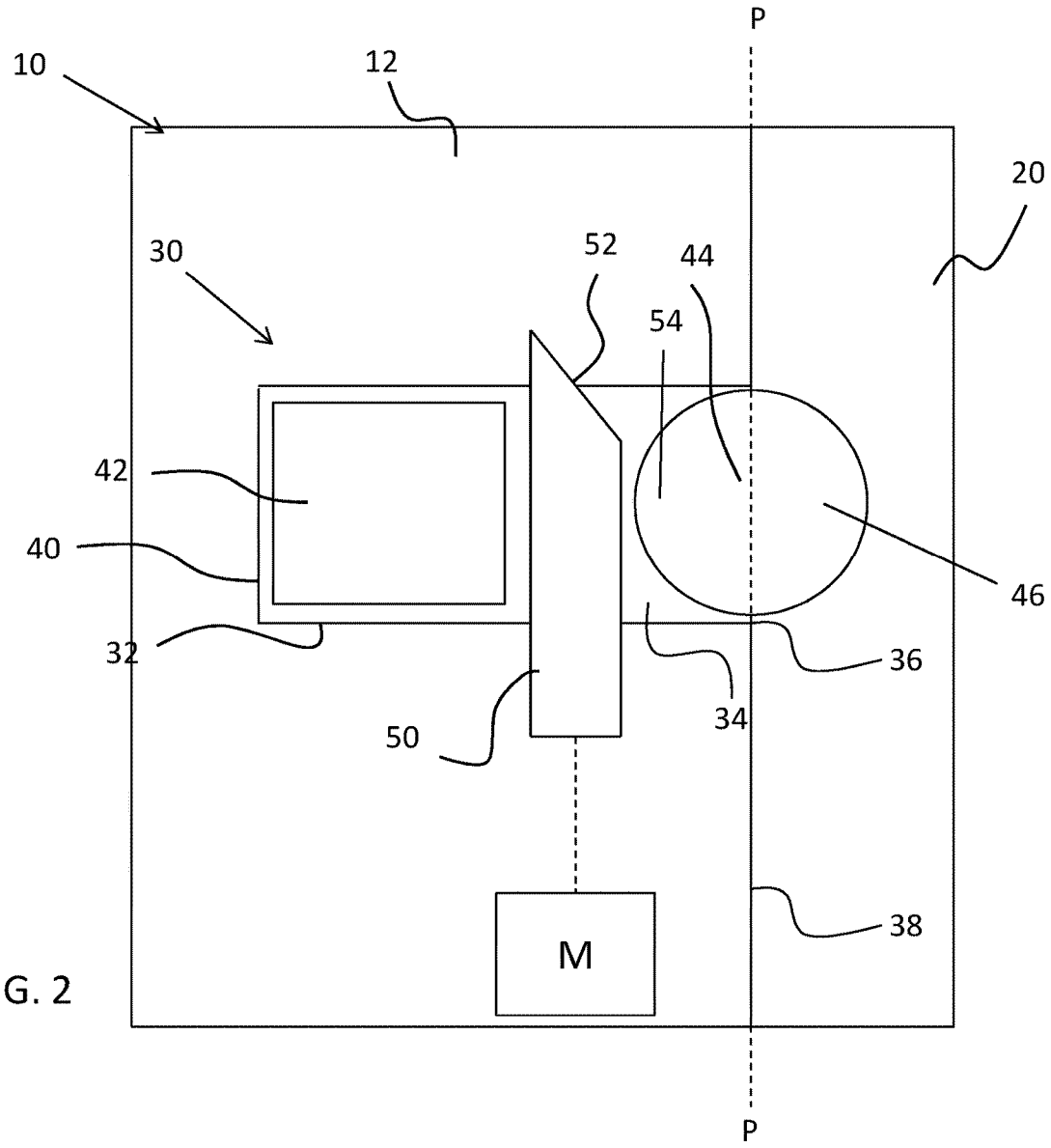
FIG. 2 is a detailed cross-sectional view of a locking module of the locking device in a locked configuration according to an embodiment.

A locking element 44 arranged within the housing 32 is formed from or includes any suitable magnetic material. In some embodiments, a suitable magnetic material includes a composite magnetic material, or alternatively, may include a non-magnetic material having a separate magnetic component or material attached to a portion thereof. In an embodiment, the locking element 44 is formed from a material having a high shear strength, such as about 10,000 lbs for example. The locking element 44 is movable between a first "locked" position, as shown in FIG. 2, and a second "unlocked" position illustrated in FIG. 3. In an embodiment, in the locked position, the locking element 44 is arranged adjacent the first end 36 of the housing 32 such that a portion 46 of the locking element 44 extends beyond the plane P defined by the first end 36 of the housing 32 and the end 38 of the first component 12. In the locked position, the portion 46 of the locking element 44 extending beyond the plane P is received within a groove or detent 48 (see FIG. 3) formed in a corresponding portion of the second component, such as the keybox 20. The detent 48 is generally aligned with the locking element 44 and may have a size and shape generally complementary to the portion 46 of locking element 44 received therein. When the locking element 44 is in the unlocked position, the entirety of the locking element 44 is located within the hollow interior 34 of the housing 32.

Figure 4:
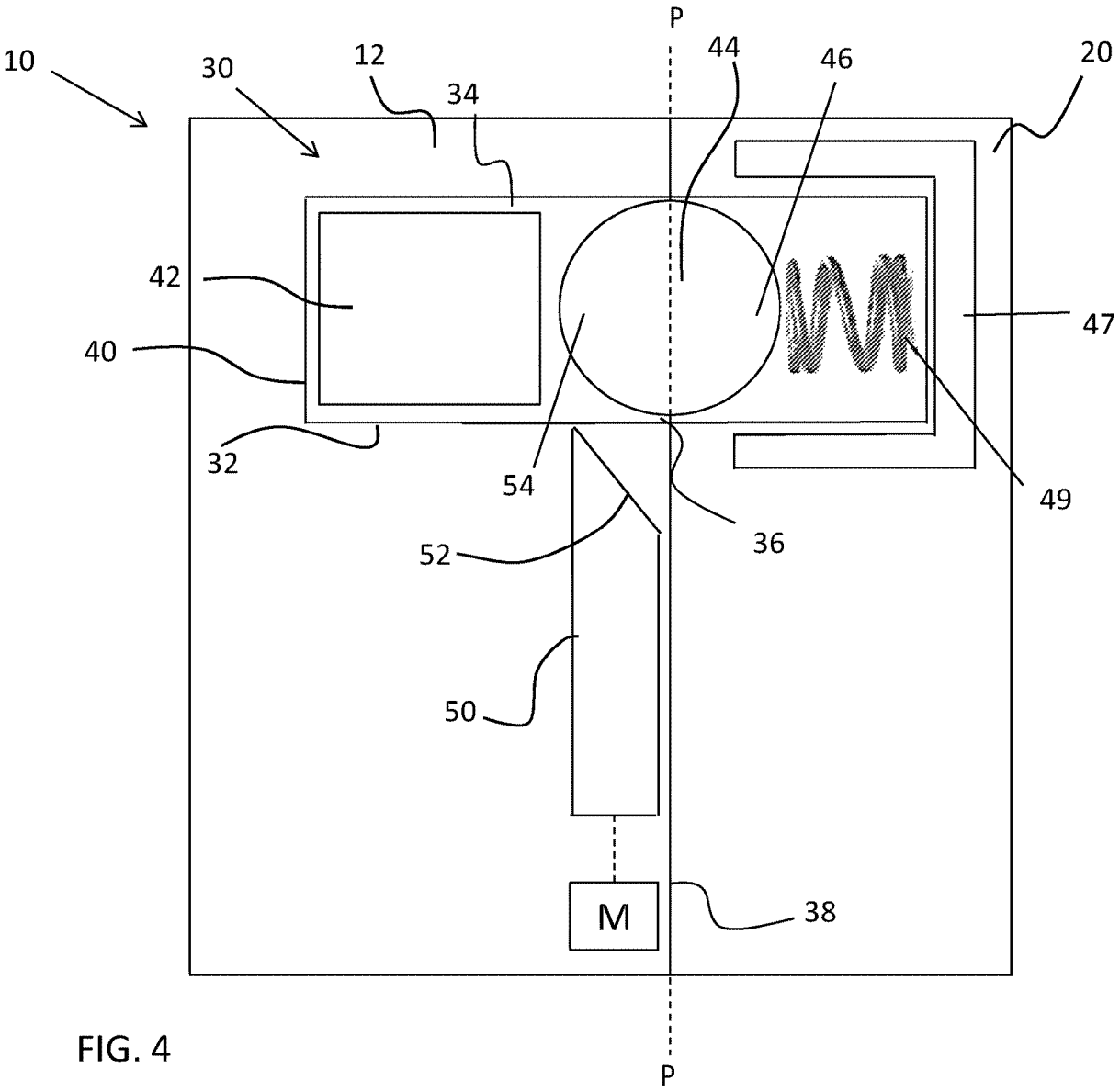
FIG. 4 is a cross-sectional view of a locking module of the locking device in a locked configuration according to another embodiment.
Figure 5:
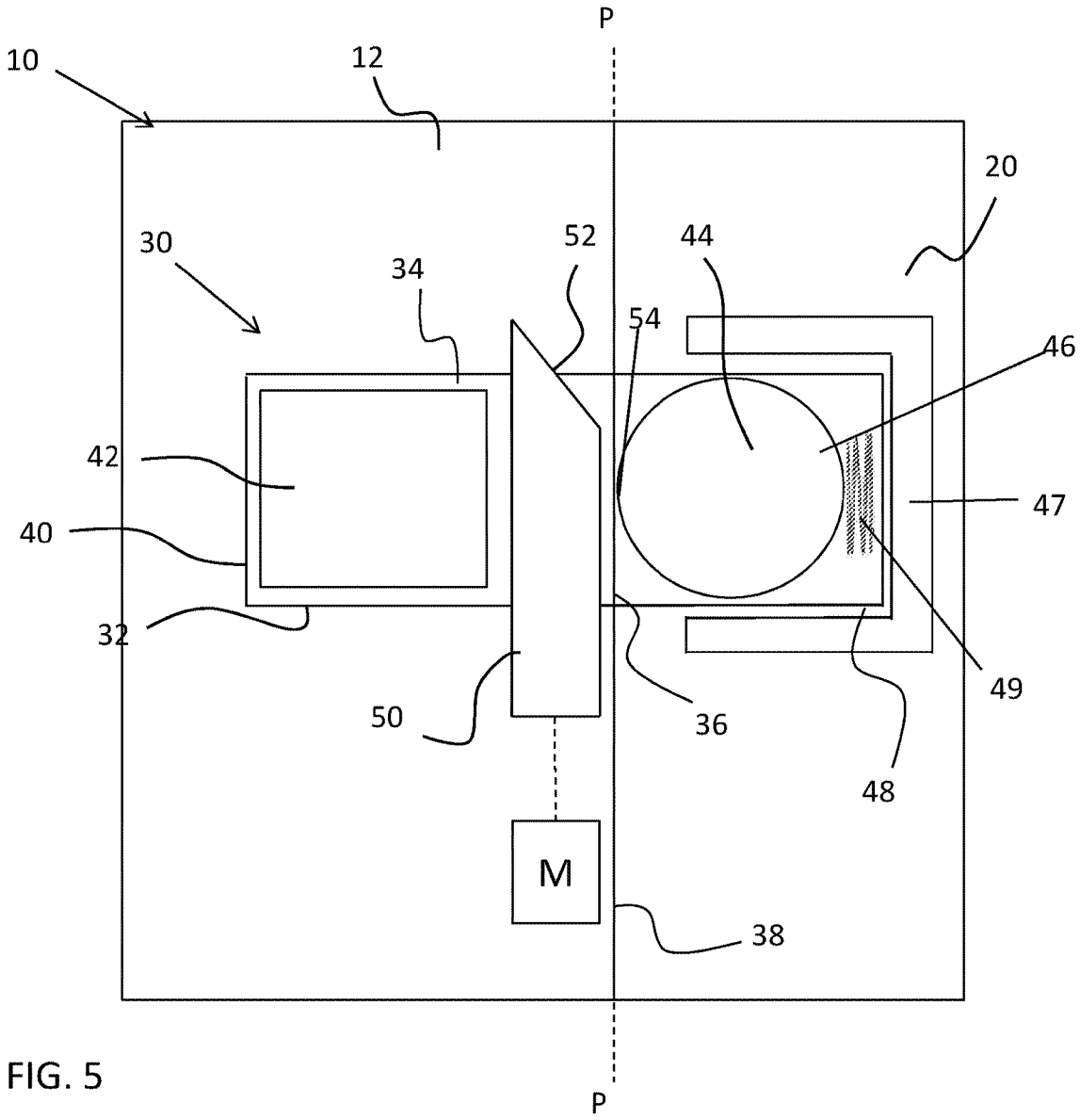
FIG. 5 is a cross-sectional view of a locking module of the locking device of FIG. 4 in an unlocked configuration according to an embodiment.

In another embodiment, illustrated in FIGS. 4 and 5, the locking module 30 extends between the first component 12 and the second component 20. As shown, the locking element 44 may be arranged in a first "locked" position when the locking element is magnetically coupled to the permanent magnet 42. As previously described, in the locked position, the locking element 44 is positioned such that the plane P intersects a generally central portion of the locking element 44. As a result, in the locked position, a portion of the locking element 44 is arranged within the first component 12 and a portion of the locking element 44 is arranged within the second component 20. In the unlocked position, shown in FIG. 5, the locking element 44, in its entirety, is positioned on one side of the plane P, within the detent 48 formed in the second component 20. In an embodiment, a shield 47 is positioned within the second component 20 adjacent or surrounding an end of the detent 48. The shield 47 may be formed from any suitable material capable of reducing or negating the strength of a magnetic field generated adjacent the detent 48. Inclusion of the shield 47 is intended to inhibit a vandal's ability to open the locking module 30 by using a magnet stronger than the magnet 42 to move the locking element 44 to the unlocked position.

When the locking element 44 is in the unlocked position, at least one of the first component 12 and the second component 20 is movable relative to the other. In the illustrated, non-limiting embodiment, the first component 12 is configured to slide relative to the second component 20. During this sliding, movement of the locking element 44 from the detent 48 is restricted by the surface of the first component 12 arranged within plane P. Alternatively, or in addition, the locking element 44 may be coupled to a biasing mechanism 49 associated with the detent 48 to limit movement of the locking element 44.

Figure 3:
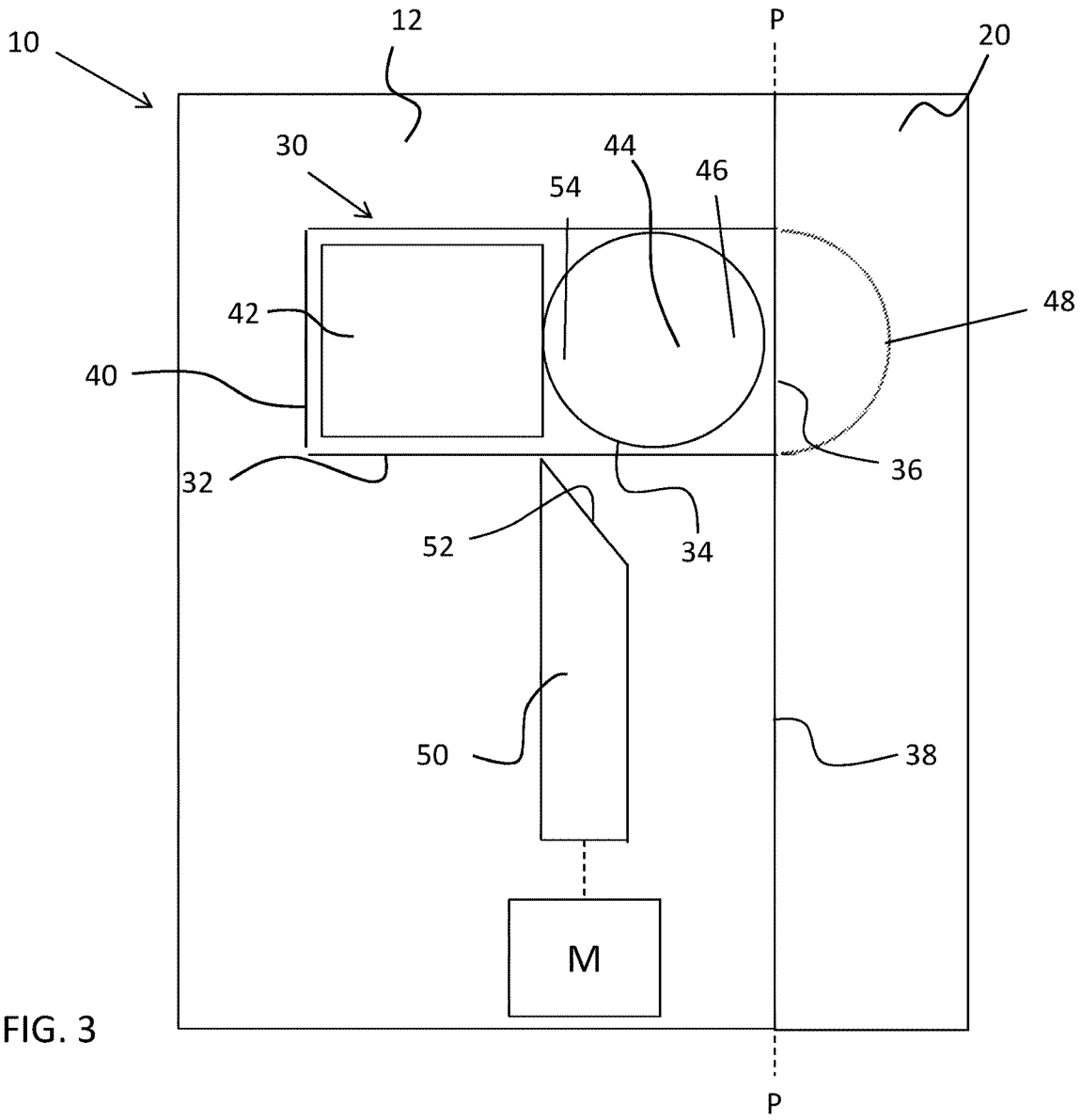
FIG. 3 is a cross-sectional view of a locking module of the locking device of FIG. 2 in an unlocked configuration according to an embodiment.

An engagement member 50 is movable relative to the housing 32 to selectively decouple the magnet 42 and the locking element 44. With reference to FIGS. 2 and 3, this decoupling of the locking element 44 and the magnet 42 is intended to "lock" the locking module 30; however, in the embodiment of FIGS. 4 and 5, this decoupling is intended to "unlock" the locking module 30. In the illustrated, non-limiting embodiments, the engagement member 50 is configured to move in response to operation of a mechanism, illustrated schematically at M, coupled to the engagement member 50. Although the engagement member 50 is shown as being movable along a generally vertical axis, embodiments where the engagement member is movable along a horizontal axis, or along a non-linear path are also contemplated herein. The mechanism M for moving the engagement member 50 may be mechanically operated by a user, or alternatively, may include an electromechanical mechanism, such as a motor, solenoid, or a piezoelectric device for example, directly or indirectly coupled to the engagement member 50. In such embodiments, the motor may be operable in response to an electrical input, such as generated by a code entered via a key pad or upon detection of an identification device, such as an RFID tag for example, having acceptable credentials.

The engagement member 50 may be formed from any suitable material, including, but not limited to a self-lubricating nylon material for example. An end 52 of the engagement member 50 is contoured to facilitate separation of the locking element 44 from the magnet 42. In an embodiment, the end of the engagement member 50 includes a contoured surface, for example generally angled, and the portion 54 of the locking element 44 contacted by the engagement member 50 is generally rounded. Although the locking element 44 illustrated in the FIGS. is generally spherical in shape, embodiments of the locking element 44 having any shape configured to cooperate with the contour of the engagement member 50, such as a cylindrical dowel having a rounded portion 54 for example, are also within the scope of the disclosure.

With reference again to FIGS. 2 and 3, in operation, a user provides an input to operate the mechanism M associated with the engagement member 50. In response to the input, the mechanism M moves the engagement member 50 out of contact with the locking element 44. The strength of the magnetic force of the magnet 42 attracts the locking element 44, thereby moving the locking element 44 from within the detent 48 of the second component 20 into the housing 32 to the unlocked position. In some embodiments, as shown, the magnetic force of the magnet 42 may cause the locking element 44 to move into contact with the magnet 42. In other embodiments, when the locking element 44 is in the unlocked position, the locking element 44 is not in direct contact with the magnet 42.

To return the locking element 44 to the "locked" position, the mechanism M is operated to move the engagement mechanism 50 towards the housing 32. The engagement mechanism 50 is generally aligned with an interior edge of the engagement mechanism 50 when in the unlocked position. As the engagement mechanism 50 moves, the contoured surface 52 of the engagement member 50 applies a force to the locking element 44 to move the locking element 44 in a direction substantially perpendicular to the movement of the engagement member 50, towards the first end 36 of the housing 38 and into the detent 48 formed in the second component 20. In some embodiments, the mechanism M is not operable when the housing 32 of the locking module 30 and the second component 20 are not aligned.

It should be understood that with respect to embodiments of FIGS. 4 and 5, movement of the engagement member 50 out of contact with the locking element 44, causes the locking element 44 to move into contact with the magnet 42, thereby locking the locking module 30. Similarly, movement of the engagement member 50 into contact with the portion 54 of the locking element 44 causes the locking element 44 to separate from the magnet 42 and apply a compressive force to the biasing mechanism 49 such that the locking element 44 moves to an unlocked position. The locking element 44 is retained in position within the detent 48 by contact with the planar surface of the first component 12.

The locking module 30 illustrated and described herein has a simplified configuration, thereby reducing cost. Because the engagement member 50 is self-lubricating, and self-cleaning as it moves relative to the housing 32, the locking module 30 has a reduced potential for maintenance. In addition, because there is no oil requirement to maintain operation of the locking module, smooth operation can be achieved in all temperatures, including extreme cold. Through use of a magnet, operation of the locking module may be accomplished in any position with respect to gravity. Further, the high shear strength of the locking element limits the ability to operate the locking module through vandalism. Additionally, in the event that the locking element 44 is temporarily separated from the magnet 42, the strength of the magnet 42 will attract the locking element 44 such that the locking module 30 has a self-restoring property.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed:

1. A locking module for selectively coupling a first component and a second component of a lockable device comprising:

a housing;

a magnet arranged within said housing;

a locking element movable relative to said housing between an unlocked position and a locked position; and an engagement member movable to selectively decouple said locking element from said magnet to move said locking element between said unlocked position and said locked position, wherein when said engagement member is positioned between the magnet and the locking element, the locking element is in the unlocked position.

2. The locking module of claim 1, wherein in said unlocked position, said locking element is positioned within said detent.

3. The locking module of claim 1, wherein in said locked position, a portion of said locking element extends outwardly beyond a first end of said housing.

4. The locking module of claim 1, wherein said locking element includes a magnetic material.

5. The locking module of claim 1, wherein said engagement member includes a contoured surface configured to cooperate with said locking element.

6. The locking module of claim 5, wherein said contoured surface includes an angled surface.

7. The locking module of claim 1, wherein said magnet is a permanent magnet.

8. The locking module of claim 7, wherein said magnet is formed from an alloy of neodymium.

9. The locking module of claim 1, further comprising a mechanism operably coupled to said engagement member.

10. The locking module of claim 9, wherein said mechanism is a mechanical mechanism that operates the engagement member in response to a user input.

11. The locking module of claim 9, wherein said mechanism is an electromechanical mechanism that operates the engagement member in response to a user input.

12. The locking module of claim 9, wherein said mechanism moves said engagement member in a first direction and engagement member is operable to apply a normal force to said locking element.

13. The locking module of claim 1, further comprising:

a detent arranged adjacent said housing, said detent being aligned with said housing such that said locking element is receivable within said detent; and a shield positioned adjacent said detent, said shield being capable of reducing or negating an external magnetic field applied to said detent to move said locking element to said unlocked position.

14. A method of operating a locking module of a lockable device comprising:

operating a mechanism in response to a user input;

moving an engagement member operably coupled to said mechanism into engagement with a portion of a locking element of the locking module, wherein when said mechanism is moved into engagement with said portion of said locking element, said engagement member is positioned between said locking element and a magnet; and applying a force to said locking element in a direction opposite a magnetic field of the magnet attracting said locking element to move said locking element from a first locked position to a second unlocked position.

15. The method of claim 14, wherein said force applied to said locking element is generally perpendicular to movement of said engagement member.

16. The method of claim 14, wherein said mechanism is operable in response to a mechanical input.

17. The method of claim 14, wherein said mechanism is operable in response to an electromechanical input.

18. A locking module for selectively coupling a first component and a second component of a lockable device comprising:

a housing;

a magnet arranged within said housing;

a locking element movable relative to said housing between an unlocked position and a locked position;

a detent arranged adjacent said housing, said detent being aligned with said housing such that said locking element is receivable within said detent;

a shield positioned adjacent said detent, said shield being capable of reducing or negating an external magnetic field applied to said detent to move said locking element to said unlocked position; and an engagement member operable to selectively decouple said locking element from said magnet to move said locking element between said unlocked position and said locked position.

* * * * *